US007717258B2

(12) United States Patent
Stephens

(10) Patent No.: US 7,717,258 B2
(45) Date of Patent: May 18, 2010

(54) CONTAINER FOR STORING AND DISPENSING PRODUCT

(75) Inventor: Jerry Ray Stephens, Hamilton, OH (US)

(73) Assignee: The Procter + Gamble Company, Cincinnati, OH (US)

( * ) Notice: Subject to any disclaimer, the term of this patent is extended or adjusted under 35 U.S.C. 154(b) by 1042 days.

(21) Appl. No.: 11/096,099

(22) Filed: Mar. 31, 2005

(65) Prior Publication Data

US 2006/0219812 A1 Oct. 5, 2006

(51) Int. Cl.
*B65D 83/08* (2006.01)
*B65D 5/42* (2006.01)
*B65D 77/24* (2006.01)

(52) U.S. Cl. ..... 206/233; 206/494; 206/213.1

(58) Field of Classification Search ..... 206/233, 206/449, 494, 581, 213.1, 205, 459.5, 459.1, 206/457, 812, 823; 239/41
See application file for complete search history.

(56) References Cited

U.S. PATENT DOCUMENTS 1,983,691 A * 12/1934 Bonardi ..... 312/31
3,038,473 A 6/1962 Ladd
3,711,024 A * 1/1973 Hammond ..... 239/55
4,271,220 A 6/1981 Otto et al.
4,277,024 A * 7/1981 Spector ..... 239/36
4,283,011 A * 8/1981 Spector ..... 239/36
4,458,810 A 7/1984 Mahoney
4,469,243 A * 9/1984 Ito et al. ..... 221/34
4,513,862 A * 4/1985 Mallow ..... 206/233
4,540,721 A 9/1985 Staller
4,848,929 A 7/1989 Rawl
5,341,992 A 8/1994 Bishopp
5,556,026 A 9/1996 Blankitny
5,884,801 A 3/1999 Simpson
5,971,143 A * 10/1999 Yoshioka ..... 206/307
6,190,730 B1 * 2/2001 Matsos et al. ..... 427/212
6,349,849 B1 * 2/2002 Pehr ..... 221/33
6,581,915 B2 6/2003 Bartsch et al.
6,648,172 B2 * 11/2003 Leighton et al. ..... 221/35
6,834,847 B2 12/2004 Bartsch et al.
6,938,832 B2 * 9/2005 Sada ..... 239/41
7,004,313 B2 2/2006 Mitchell et al.
2004/0099545 A1 5/2004 De-Vries
2004/0124101 A1 * 7/2004 Mitchell et al. ..... 206/205
2007/0039840 A1 * 2/2007 Mu et al. ..... 206/278

FOREIGN PATENT DOCUMENTS

DE 296 13 125 U1 11/1996

(Continued)

*Primary Examiner*—Jila M Mohandesi
*Assistant Examiner*—Steven A. Reynolds
(74) *Attorney, Agent, or Firm*—Peter D. Meyer; David M. Weirich

(57) ABSTRACT

A disposable container for the storage and/or dispensing of products. The disposable container includes one or more sides that define an external surface and an internal surface. The container includes one or more apertures that extend from the internal surface to the external surface. A carrier material having a volatile material disposed on one side thereof is joined to at least one side of the container and is located adjacent at least one of the apertures. This configuration allows the volatile material, when violatilized, to pass through the aperture(s) to the external environment.

20 Claims, 8 Drawing Sheets

FOREIGN PATENT DOCUMENTS

| | | | |
|---|---|---|---|
| EP | 1 164 084 | A | 6/2000 |
| FR | 2 864 428 | A | 7/2005 |
| JP | 11-079263 | | 3/1999 |
| JP | 2001-029261 | | 2/2001 |
| JP | 2004-115055 | | 4/2004 |

* cited by examiner

CONTAINER FOR STORING AND DISPENSING PRODUCT

TECHNICAL FIELD OF THE INVENTION

The present invention relates generally to the field of disposable containers for storing and dispensing products, such as, for example facial tissues and wipes.

BACKGROUND OF THE INVENTION

The use of boxes or containers to store and dispense articles, such as, for example tissues, is well known. Some of the advantages of boxes for the storage and dispensing of articles such as tissues include ease of shipping and storage and convenience to the end user. While the convenience of having a readily accessible supply of tissues or other products on hand is apparent, some storage containers can be visually and/or otherwise unappealing. Thus, there has been a need to provide a more aesthetically pleasing container to fit the décor of the room in which the tissues or other products are stored and/or dispensed. This need has resulted in the development of decorative boxes. While decorative boxes have proven to be consumer preferred in many instances, such as, for example, for facial tissues, there is still a need to improve such boxes to provide containers that can better match the overall decorative theme of a particular space. Such improvements might include more preferred graphics and other visual elements, but may also include the addition of olfactory elements as well.

One attempt to meet the desire for facial tissue containers to provide an olfactory element has resulted in the development of a non-disposable facial tissue container and dispenser that is capable of providing an odor to the environment surrounding the container. For example, in JP-11210095, a reusable facial tissue container is provided which includes storage spaces that are built into the lid of the container. The storage spaces allow the user to place a material such as potpourri therein and thus, the scent can be provided to the surrounding environment. One drawback of such a design, however, is the non-disposability of the container. Because the container is non-disposable, it is likely to be a relatively high cost in relation to the products stored therein. Another disadvantage of the non-disposable container is that the fragrant material used to provide the desired scent is separate from the container itself, and thus, is likely purchased and stored separately, adding inconvenience for the user. Additionally, the scent producing material used must be monitored separately from the product stored therein so that it can be changed when the scent is no longer sustained at a level satisfactory to the user.

Another example of a facial tissue container that provides a scent to the surrounding environment is a disposable facial tissue box with a strip of fragrant material disposed on the outside surface of the container, such as the container described in U.S. Pat. No. 5,341,992. The strip of fragrant material is disclosed to be on the outside face of the container and is covered with a relatively vapor impermeable material so that the fragrant material is conserved when the container is not in use, e.g. prior to purchase by the user. The user must then only remove the cover material to expose the scent producing material to the environment and thus, provide a scent to the environment. Although an improvement over the non-disposable container described above, there are still disadvantages associated with this type of container having the fragrant material disposed on one or more of its outside surfaces. First, because the scent is placed on the outside of the container, there is a possibility that the cover material will be damaged and prematurely expose the volatile fragrant material to the environment. Worse, damage to the cover material could lead to the fragrant material being transferred onto a surface it was not intended to touch, for example, a user's clothing, automobile upholstery or furniture. In addition, because the scented material is applied to the surface of the container as a strip or other carrier material, it may introduce deformities or raised portions to the container that may translate into shipping or storage inefficiencies.

Accordingly, it would be desirable to provide a disposable container for dispensable products that includes a fragrance. It would also be desirable to provide a container that includes decorative indicia and a fragrance. It would also be desirable to provide a container that includes decorative indicia and a fragrance, wherein the decorative indicia and the fragrance are related to each other. Further, it would be desirable to provide a container that includes decorative indicia, a fragrance, and a means for introducing the fragrance to the environment, such as, for example apertures in the container, where the means for introducing the fragrance to the environment is related to the decorative indicia and/or the fragrance.

SUMMARY OF THE INVENTION

In order to provide a solution to the inconveniences set forth above in relation to the prior art, the invention provides a disposable container for the storage and dispensing of products. The disposable container includes one or more sides that define an external surface and an internal surface. The internal surface defines a partially or wholly enclosed internal space for storing the products. One or more apertures in the container extend from the internal surface to the external surface. A vapor impermeable carrier material having a first side and a second side and including a volatile material contained on one side thereof, is joined to the internal surface of at least one side of the container and is located adjacent at least one of the one or more apertures such that the volatile material, when volatilized, can pass through at least one of the one or more apertures to the external environment.

In another aspect of the invention, a blank used to form the container is provided. The blank includes a wall that includes a volatile material disposed on one side thereof.

DETAILED DESCRIPTION OF THE INVENTION

Figure 1:
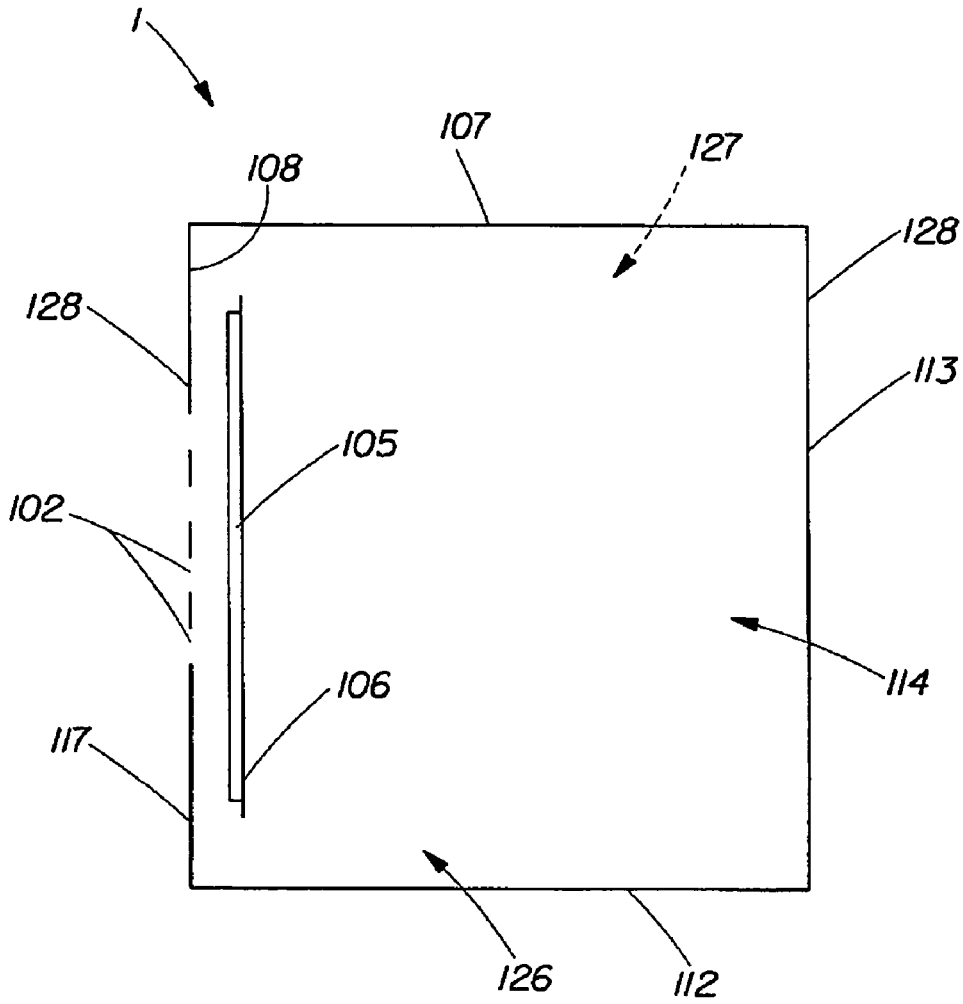
FIG. 1 is side view of one embodiment of the present invention.

FIG. 1 shows the cross-section of one embodiment of the present invention. The container 1 shown is configured from a front panel 117, a back panel 113, a top panel 107, a bottom panel 112, a first side panel 126, and a second side panel 127. As shown, the container 1 is generally parallelepiped in shape. (As used herein the term "parallelepiped" refers to a 6-faced polyhedron all of whose faces are parallelograms lying in pairs of generally parallel planes.) Typically, the container 1 will include at least six panels, but embodiments are contemplated wherein fewer or more panels are used, as desired.

The container 1 is useful for storing and/or dispensing products such as, for example, tissue products. It should be noted, however, that the container 1 is not limited to the storage of facial tissue, but may be used to store any type of disposable or reusable consumer product, including but not limited to toilet tissue, wipes, or napkins, etc.

The panels 117, 113, 107, 112, 126, 127 of the container 1 each have an external (or exterior) surface 128 and an internal (or interior) surface 108 wherein the internal surfaces 108 of the panels 117, 113, 107, 112, 126, 127 define an internal (or interior) storage space 114 of the container 1 for the storage of products and from which the products are dispensed. The internal storage space 114 of the container 1 may be further defined by one or more additional materials such as a liner, a coating on the internal surface 108 of at least one of the panels 117, 113, 107, 112, 126, 127 or by any other structure provided inside at least one of the panels 117, 113, 107, 112, 126, 127 of the container 1.

As shown in FIG. 1, the container 1 may include a front panel 117 that includes one or more apertures 102 that extend from the internal surface 108 of the container 1 to the external surface 128. Further, the container 1 may additionally or alternatively include apertures 102 in any other panel or portion of the container 1, as desired.

As shown in FIG. 1, in this particular embodiment, joined to the internal surface 108 of the front panel 117 is a carrier material 106. The carrier material 106 is intended to provide a volatile material; such as, for example a fragrance. The carrier material 106 may be any suitable material, including but not limited to films of any makeup, paper, foil, webs of material or the like and/or any combinations thereof. Generally, it is desirable that the carrier material 106 comprise a material suitable for preventing the passage of vapor or fluid from one side of the carrier material 106 to the other. However, embodiments are contemplated where the carrier material 106 permits the passage of certain vapors and/or fluids, or permits the passage of certain vapors and/or fluids at a predetermined rate.

In one example, the carrier material 106 may take the form of a film comprising a volatile material 105 disposed on one side thereof. In another example the carrier material 106 is impregnated with the volatile material 105.

Figure 2:
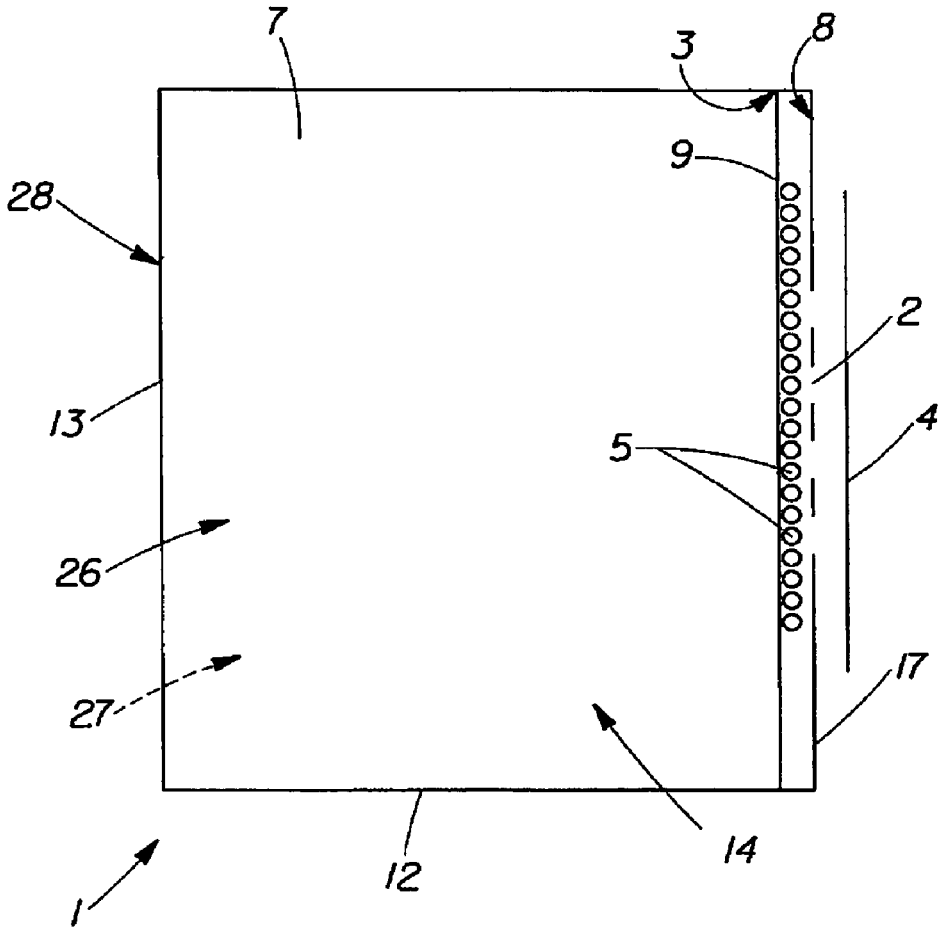
FIG. 2 is a side view of an alternative embodiment of the present invention.

FIG. 2 shows the cross-section of an alternative embodiment of the present invention useful for the storage and dispensing of products. In this embodiment, the volatile material 5 is disposed on or in a carrier material 9 that comprises a wall of the container 1. In one example, the fifth wall 9 may take the form of a wall comprising a volatile material 5 disposed on one side thereof. In another example the fifth wall 9 is impregnated with the volatile material 5.

As shown, the fifth wall 9 is attached by fold line 3 to the top panel 7 of the container 1 such that the fifth wall 9 is interposed between the interior surface 8 of the front panel 17 and the interior storage space 14 of the container 1. The position of the fifth wall 9 is not limited to being adjacent the front panel 17, but may be interposed between the interior surface 8 of the top panel 7, the bottom panel 12, the back panel 13, or any other panel or panels and the interior storage space 14 of the container 1. The fifth wall 9 may or may not be joined to the interior surface 8 of one or more other panels, such as, for example, the bottom panel 12, via an adhesive or any other attaching means.

As shown in FIG. 2, front panel 17 includes at least one aperture 2. (It should be noted that the particular panel having apertures 2 is not important, but rather the placement of the volatile material 5 near the panel having the apertures 2.) Generally, it is desirable that the fifth wall 9 be positioned adjacent the apertures 2, so that when volatilized at least some of the volatile material 5 is capable of passing through the apertures 2 to the external environment. Additionally, it may be desirable to provide the fifth wall 9 with suitable thickness, or to construct the fifth wall 9 of a suitable material such that the amount of volatile material 5 transferred to the product, such as, for example facial tissue stored inside the container 1, will be limited. Additionally, the fifth wall 9 may be coated on one or both sides with any material that will retard or prevent the volatile material 5 from being transferred to the product. However, embodiments are contemplated where the fifth wall 9 permits the passage of certain vapors and/or fluids, or permits the passage of certain vapors and/or fluids at a predetermined rate.

The volatile material 5 of the present invention may include any suitable volatile material, and in certain embodiments the volatile material may include an essential oil. (As used herein the term essential oil refers to a volatile oil that occurs in a plant and in general gives to the plant its characteristic odor, flavor, or other such property). Other exemplary volatile materials 5 may include, but are not limited to, any single composition or any combination of the following; ajowan, almond, allspice, aloe vera, ammi visnaga (khella), amyris, angelica root, angelica seed, anise, apricot, absolute arnica, avocado, balsam, basil, bay laurel, bay leaf, bees wax, benzoin absolute, bergamot, birch, borage, boronia, buchu leaf, cajeput, calamus, calendula, camellia, cannabis, caraway, cardamom, absolute carnation, carrot seed, cassia, cassis bud (black currant), castor, catnip, cedarleaf, cedarwood, celery seed, chamomile, champaca, cilantro, cinnamon, cistus, citronella, ciste, artificial civet, clary sage, Clementine, clove, cocoa, cocoa butter, coconut, cognac, combava petiLgrain, coriander, cornmint, costus, cumin, cypress, davana, dill, dill weed, elemi, erigeron (fleabane), eucalyptus, fennel, fenugreek, fir, frankincense, galbanum, garlic, genes, geranium, ginger, ginseng, grapefruit, grapeseed, hazelnut, helichrysum, hemp, absolute honeysuckle, hyssop, absolute immortelle, fragrant aster inula, Jamaican gold, jasmine, jojoba, absolute jonquille, juniper berry, lanolin, lantana camera, laurel nobilis, lavender, lavendin, lemon, lemongrass, lime, litsea, lotus, macadamia, mace, mandarin, manuka, marigold, marjoram, massoia bark, melissa, mimosa, monarda, mugwort, musk seed, myrrh, myrtle, absolute narcissus, neroli (orange blossom), niaouli, nutmeg, oakmoss, olibanum, absolute opopanax, orange, wild West Indian orange, oregano, orris root, osmanthus, palm, palmarosa, paprika, patchouli, peanut, pecan, pennyroyal, pepper, peppermint, pet perfume, petiLgrain (orange leaves), pine, evening primrose, ravensare, redberry, rosalina, rose, rosehip seed, rosemary, rosewood, rue, sage, sandalwood, seabuckthorn berry, sesame oil, shea butter, unrefined Thea butter, spikenard, spruce, St. John's wort, styrax resin, tagetes, tangerine, tarragon, tea tree, thuja (cedar leaf), thyme, mixed tocopherols, tofu balsam resin, tuberose, tumeric, valerian, vanilla, vegetable glycerin, verbena, vetiver, vitex, violet leaf, walnut oil, wintergreen, wormwood, yarrow, ylang ylang, or other fragrances suitable for aromatherapy or the like.

The container 1 of the present invention can be made from any suitable material or materials. For example, the container 1 may be made from materials including paperboard, cardboard, chipboard, plywood, SBS, metal, plastic, paper, card stock, fabric, ceramic, polymer, natural or synthetic fibers, webs, mesh, screen, wood, composite, mixtures or combinations of the foregoing, or the like. Where multiple layers of material are used, they may be permanently or releasably joined to each other. For example, the materials may be laminated, glued or otherwise joined together.

The container 1 can be made from a single piece of material or from two or more pieces of material that are joined together by, for example, an adhesive or any other joining means discussed herein or known to those having ordinary skill in the art. In certain embodiments, the container 1 may be formed from one or more blanks that are folded or otherwise manipulated to provide the shape of the container 1. In another example, the container 1 may be constructed partially from a blank and partially from other separate materials. It is also contemplated that the container 1 could be formed by other means such as blow molding, casting or the like.

Figure 3:
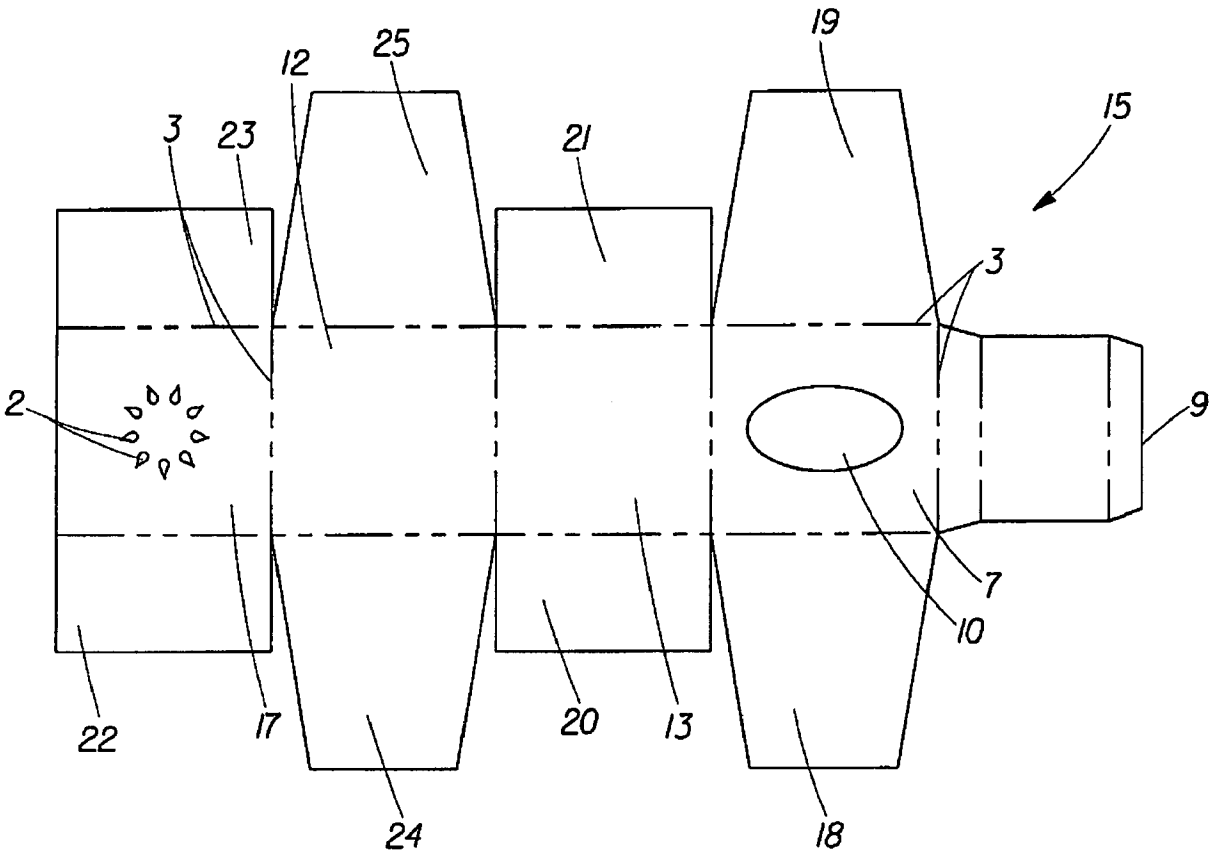
FIG. 3 is a plan view of a blank for manufacturing a container according to one embodiment of the present invention.

One example of a container according to the present invention is the container 1 constructed from blank 15, as shown, for example in FIG. 3. FIG. 3 is a plan-view of a blank 15 for forming the container 1 of FIG. 2. The blank 15 includes a top panel 7 joined to a back panel 13, a first side panel portion 18, a second side panel portion 19 and a fifth wall 9. The top panel 7 is separated from the back panel 13, the first side portion, the second side portion, and the fifth wall 9 by fold lines 3. As shown in FIG. 3, in one embodiment of the present invention, the top panel 7 of the blank 15 contains an opening 10 that provides a means of accessing the facial tissue or other product stored in the internal space 14 of the container 1 from outside the container 1. The blank 15 further includes a bottom panel 12 joined to a front panel 17, a back panel 13, a first side panel portion 24 and a second side panel portion 25. The front panel 17 is joined to side panel portions 22 and 23. The back panel 13 is joined to side panel portions 20 and 21. The back panel 13 is separated by fold lines 3 from side panel portions 22 and 23 and front panel 17 is separated from side panel portions 20 and 21 by fold lines 3.

While FIGS. 2 and 3 shows the panels in one particular configuration, it is to be understood that other configurations are possible, such as, for example, wherein the fifth wall 9 is adjacent the back panel 13, side panel 26 or 27, or front panel 17.

The front panel 17 of the blank 15 may contain one or more apertures 2, and while the apertures 2 are shown in the front panel of the blank 15, it is to be understood that other locations for the apertures 2, such as, for example the back panel 13, the top panel 7, or any other panel or panels are also contemplated by the present invention.

The blank 15 can be made of one or more layers of any material commonly used to construct facial tissue containers which includes, but is not limited to, any of the materials described hereinabove with respect to suitable materials for making the container 1 or any other suitable material known to those having ordinary skill in the art. Where multiple layers of material are used they may be joined together by any known means or method, including, but not limited to lamination, gluing or other fastening means.

The blank 15 of FIG. 3 may be die cut from a single piece of material. Alternatively, two or more segments of material may be separately provided and joined together. Where a plurality of panels or segments are used they may be joined using hinge or joint mechanisms or any other suitable means known to those of ordinary skill in the art. The blank 15 may be scored to form fold lines 3. By score, it is meant to include a cut through a portion of the blank 15 (either a continuous cut or a line of slits, holes or perforations), or a weakened area, or a compressed area on at least one face of the sheet or other manipulations of the area to permit bending of the material along a preferred line. The blank 15 can further be configured, for example, by folding the blank material along the fold lines 3 so that the panels 7, 13, 12, and 17 and side panel portions 18, 19, 20, 21, 22, 23, 24, and 25 are situated in such a way that they may be joined together to form a container having the configuration, for example, as shown in FIG. 4.

Figure 4:
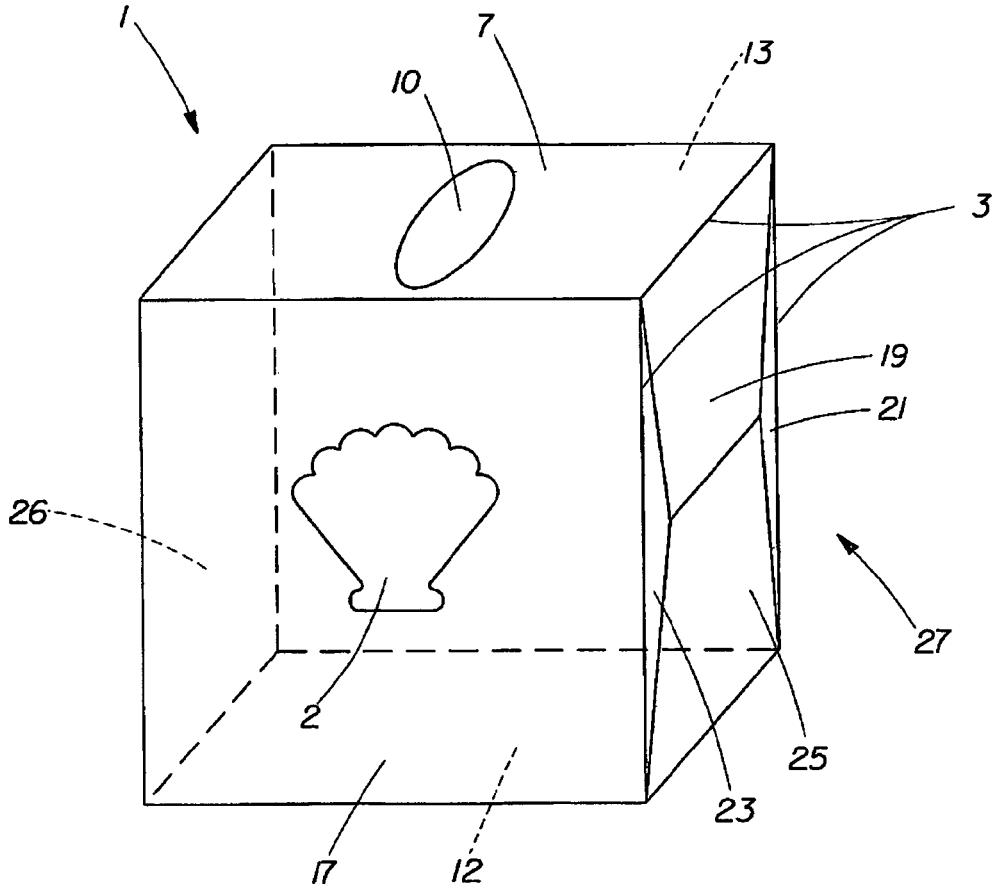
FIG. 4 is an isometric view of one embodiment of the present invention.

FIG. 4 shows an isometric view of one embodiment of the present invention. The container 1 is generally parallelepiped in shape, having a front panel 17 generally parallel to back panel 13, a bottom panel 12, generally parallel to top panel 7, and a first side panel 26 generally parallel to a second side panel 27. In the embodiment shown, the side panel 27 is comprised of four side panel portions 19, 21, 23, 25. Side panel portions 21 and 23 are joined to the back panel 13 and the front panel 17, respectively by fold lines 3. Side panel portions 19 and 25 are joined to the top panel 7 and the bottom panel 12, respectively by fold lines 3. The side panel portions 19, 21, 23, 25 may be disposed in any order suitable to form the side panel 27. Additionally, while not shown in FIG. 4, side panel portions 18, 20, 22, 24 illustrated in FIG. 3 may be used to form side panel 26. Further, the front panel 17 may contain one or more apertures 2 therein, such as, for example, the shell shaped aperture 2 shown.

The top panel 7 of the container 1 may contain an opening 10 for the removal of product from inside the container 1. While the present example shows the opening 10 located in the top panel 7, it is to be understood that the present invention also contemplates an opening for the removal of product positioned on any other panel or panels of the container 1, as desired. Additionally the opening 10 may be of any size or shape that is suitable for accessing or dispensing the product stored within the container 1.

While the aperture 2 illustrated in FIG. 4 is shown without an adjacent cover layer, it may be desirable to provide the container 1 with a cover layer adjacent at least a portion of the aperture 2 or apertures, as is described in more detail below.

Figure 5:
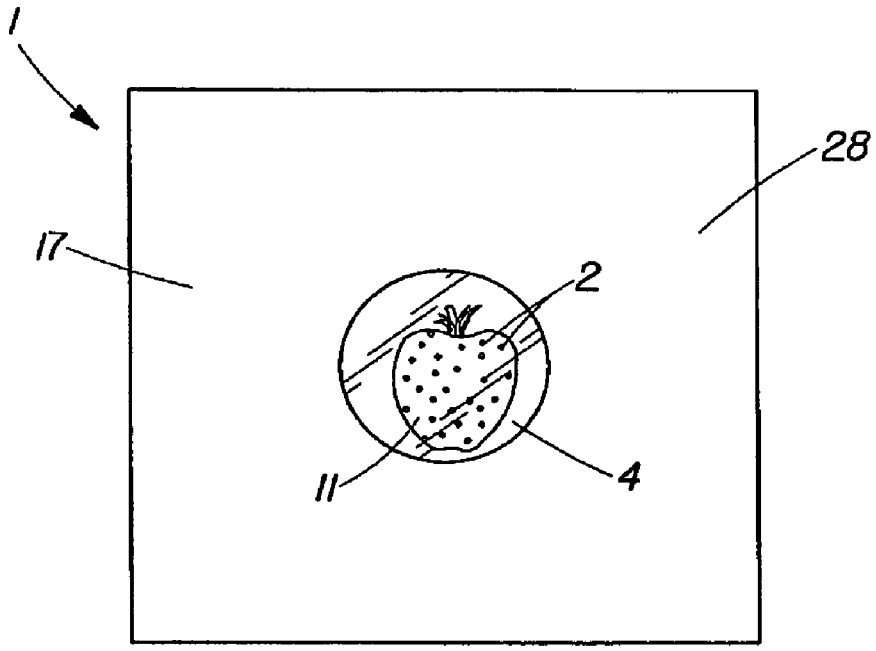
FIG. 5 is a side view of an alternative embodiment of the present invention.

FIG. 5 is a side view of a container 1 suitable for storing and dispensing product according to one embodiment the present invention. The container 1 includes one or more apertures 2 disposed in one panel thereof, such as, for example, the front panel 17. Adjacent the apertures 2, and releasably attached, by any means known to those having skill in the art, to the front panel 17 of the container 1, is a cover layer 4. The cover layer 4 may serve as a barrier to a volatile material 5, which may be disposed in the container 1. The cover layer 4 can be used to limit the amount of volatile material 5 that, when volatilized, passes through the apertures 2, or can be used to prevent the volatile material 5 from volatilizing until after the cover layer 4 is partially or completely removed.

Figure 6:
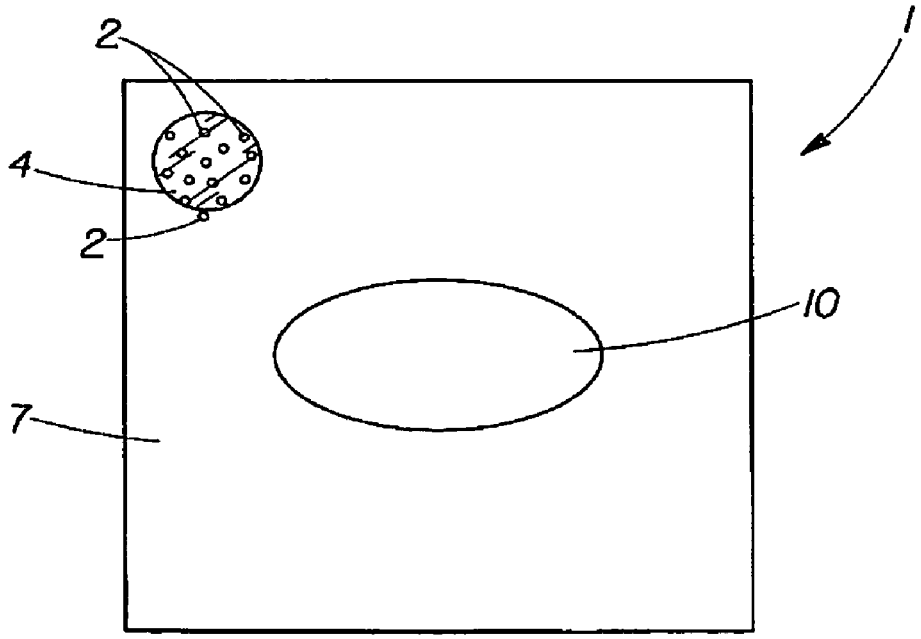
FIG. 6 is a top view of an alternative embodiment of the present invention.

The cover layer 4 may be vapor permeable or impermeable, as desired. The cover layer 4 may be made of any suitable material, including, but not limited to films of any makeup, paper, foil, webs of material or like and/or any combinations thereof. Additionally while the example shown in FIG. 5 shows a cover layer releasably attached to the external surface 28 of the front panel 17, it is to be understood that the cover layer 4 may be releasably attached to any external surface 28 of the container 1 or to any material joined to or surrounding the external surface 28 of the container 1 so long as the cover layer 4 can provide the intended benefit. It may also be desirable to provide a container 1 having a resealable cover layer whereby the cover layer may be reattached to the container 1 in order to partially or entirely cover the apertures 2 after removal. Further, as shown in FIG. 5 the cover layer 4 entirely covers the apertures 2, but it is to be understood that embodiments wherein the cover layer 4 does not entirely cover the apertures 2 are also contemplated. For example, as shown in FIG. 6, the cover layer 4 covers some, but not all of the apertures 2.

As shown in FIG. 5, container 1 may also include indicia 11 on at least one panel thereof. In the example shown, the indicia 11 are disposed on front panel 17 and include the image of a strawberry. It should be understood that the decorative indicia 11 of the present invention are not limited to any particular object or shape, but may include a single color, combinations of colors, raised portions, object(s), partial objects, or any combination(s) of objects, partial objects, or any of the aforementioned or the like that may or may not form a readily discernible picture or pattern. Further, the indicia 11 may be positioned on any or all of the panels of the container 1 or in any other location on the container 1, including but not limited to any material that may be joined to or surround the exterior side 28 of the container 1, such that the indicia 11 are detectable by the human eye when the container 1 is in normal use. The container 1 shown in FIG. 5 also includes apertures 2 that depict strawberry seeds and relate to the indicia 11. As used herein the term "relate" means to have characteristics that can logically show or establish a connection between two or more elements. In this example the apertures 2 depict strawberry seeds, and thus, relate to the indicia 11 that include the image of a strawberry.

Figure 7:
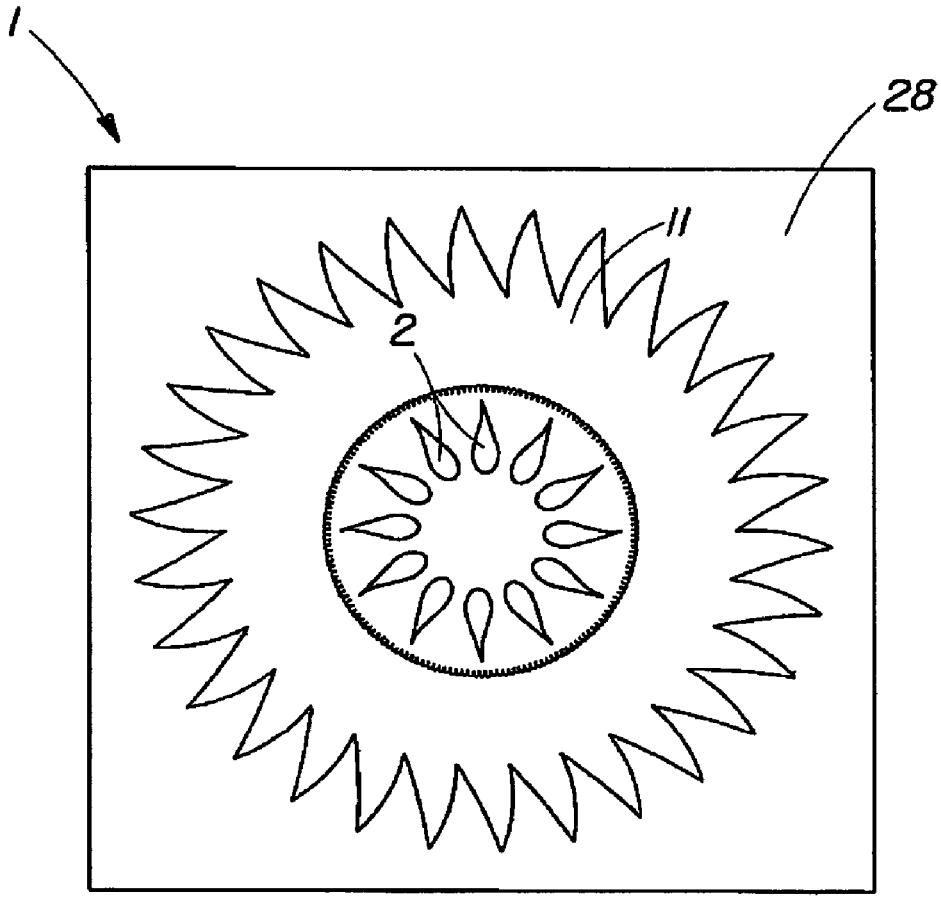
FIG. 7 is aside view of another alternative embodiment of the present invention.

FIG. 7 shows another example of a container 1 according to the present invention, wherein the container 1 includes indicia 11 that depict a sunflower and apertures 2 that depict sunflower seeds. Thus, the apertures 2 depicting sunflower seeds relate to the indicia 11 that depict a sunflower.

In addition to the aforementioned examples, it may be desirable to have a container 1 including a volatile material 5, such as, for example, a fragrance, wherein the fragrance relates to indicia 11 also included on the container 1. One such example might be a container including decorative indicia 11, such as, for example a strawberry, that relate to a particular fragrance, such as, for example strawberry essential oil. It should be understood that the volatile material 5 comprising the fragrance that is related to the indicia 11 in the present example need not be strawberry essential oil, but may include any volatile material 5 that can be related to the indicia 11. Examples include, but are not limited to an artificial strawberry fragrance or a combination of various natural or artificial fruit fragrances.

Another exemplary example of a container 1 according to the present invention may include a container 1 having apertures 2 that individually relate to a volatile material 5 comprising a fragrance or alternatively apertures 2 that when viewed together form a single image that relates to a volatile material 5. An example of this would include one or more apertures 2 in the shape of, or otherwise depicting, one or more individual roses that relate to a volatile material 5 including the fragrance of a rose. Alternatively, the apertures 2 could be in the shape of rose petals such that when viewed as a whole, depict a rose. In either case, the apertures 2 can be said to relate to the rose fragrance included in the container 1.

It may also be desirable to have a container 1 including a number of different indicia 11 which, when viewed as a whole, include a scene of one or more images. In such embodiments, it may be desirable to relate the indicia 11 of the scene to a volatile material 5 including a fragrance. One non-limiting example of such a container would include a container 1 having indicia 11 depicting a beach scene depicting, for example, sunbathers, sail boats, seabirds, seashells and other sights often associated with a beach, wherein the container 1 further includes a volatile material 5 including, for example, a scent reminiscent of the ocean. Thus, the indicia 11 are related to the fragrance of the volatile material 5.

In addition to having a container 1 including apertures 2 that relate to certain indicia 11, and a container 1 including indicia 11 that relate to a particular fragrance, it may be desirable to have a container 1 wherein the apertures 2, the indicia 11, and the volatile material 5 including a fragrance all relate to each other. One exemplary embodiment includes the container 1 of FIG. 7 having the indicia 11 depicting a sunflower and apertures 2 depicting sunflower seeds. In this embodiment, the container 1 would also include a volatile material 5 providing a fragrance related to the sunflower, such as, for example the scent of a flower or even a sunflower. Such an embodiment provides the user with a unique way to achieve an overall decorative theme by coordinating the elements of both the visual and olfactory experiences that appeal to the user's particular tastes.

Figure 8:
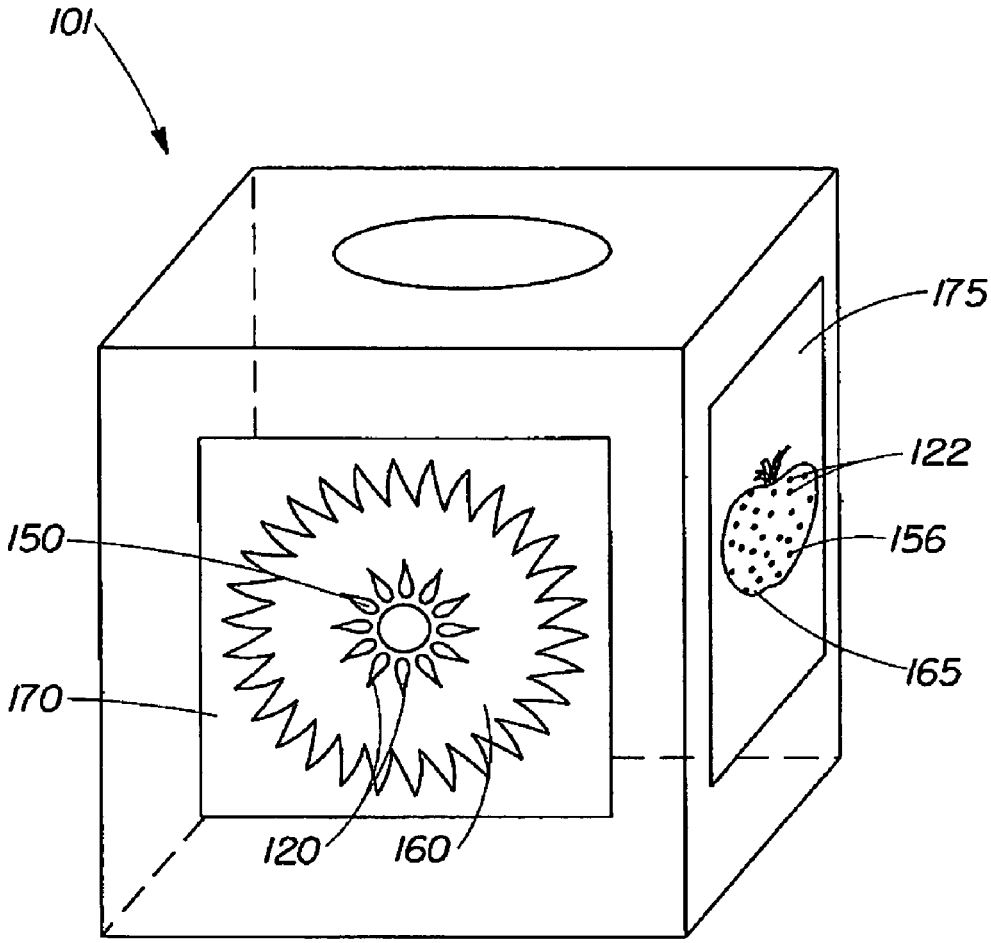
FIG. 8 is an isometric view of another alternative embodiment of the present invention.

FIG. 8 shows another example of a container 101 according to the present invention wherein the container 101 includes first indicia 160 and second indicia 165. The first indicia 160 and the second indicia 165 are shown to be different and generally unrelated to each other. Thus, in this example, the sunflower depicted by the first indicia 160 and the strawberry depicted by second indicia 165 are different, and are not typically related to each other. However, it is to be understood that the first indicia 160 and the second indicia 165 may be different but still be related to each other.

The container 101 shown in FIG. 8 also includes apertures 120 that depict sunflower seeds, and apertures 122 that depict strawberry seeds. The sunflower seed apertures 120 relate to the first indicia 160 of the sunflower and the strawberry seed apertures 122 relate to the second indicia 165 of the strawberry. While the apertures 120 and 122 of the container 101 are shown to be related to certain indicia on the container 101, other embodiments are contemplated wherein the apertures 120 and/or 122 may not be related to all or part of any indicia that may be present on the container 1.

The container 101 of FIG. 8 may also include one or more volatile materials including one or more fragrances. The volatile material(s) and or fragrance(s) may relate to all or part of the indicia on the container 101. An example of an embodiment of such a container would include the container 101 of FIG. 8 including a first volatile material 150 comprising the fragrance of a sunflower, and a second volatile material 156 comprising the fragrance of a strawberry. In one example, the first volatile material 150 would be disposed adjacent the first indicia 160 of the sunflower and the second volatile material 156 would be disposed adjacent the second indicia 165 of the strawberry.

The container 101 could also include one or more releasably attached cover layers that cover a portion or all of at least one of the volatile materials 150 or 156. In certain embodiments, an example of which is shown in FIG. 8, two or more individual cover layers, such as cover layers 170 and 175, can be employed to permit the user to expose each volatile material 150 or 156 individually or both of them simultaneously. Further, more than one cover layer could be provided for each volatile material such that the user could control the amount or portion of the volatile material that is exposed to the environment at any particular time. In any case, the cover layer(s) may be resealable to permit the user to close of one or both of the volatile materials 150 and 156.

Figure 9:
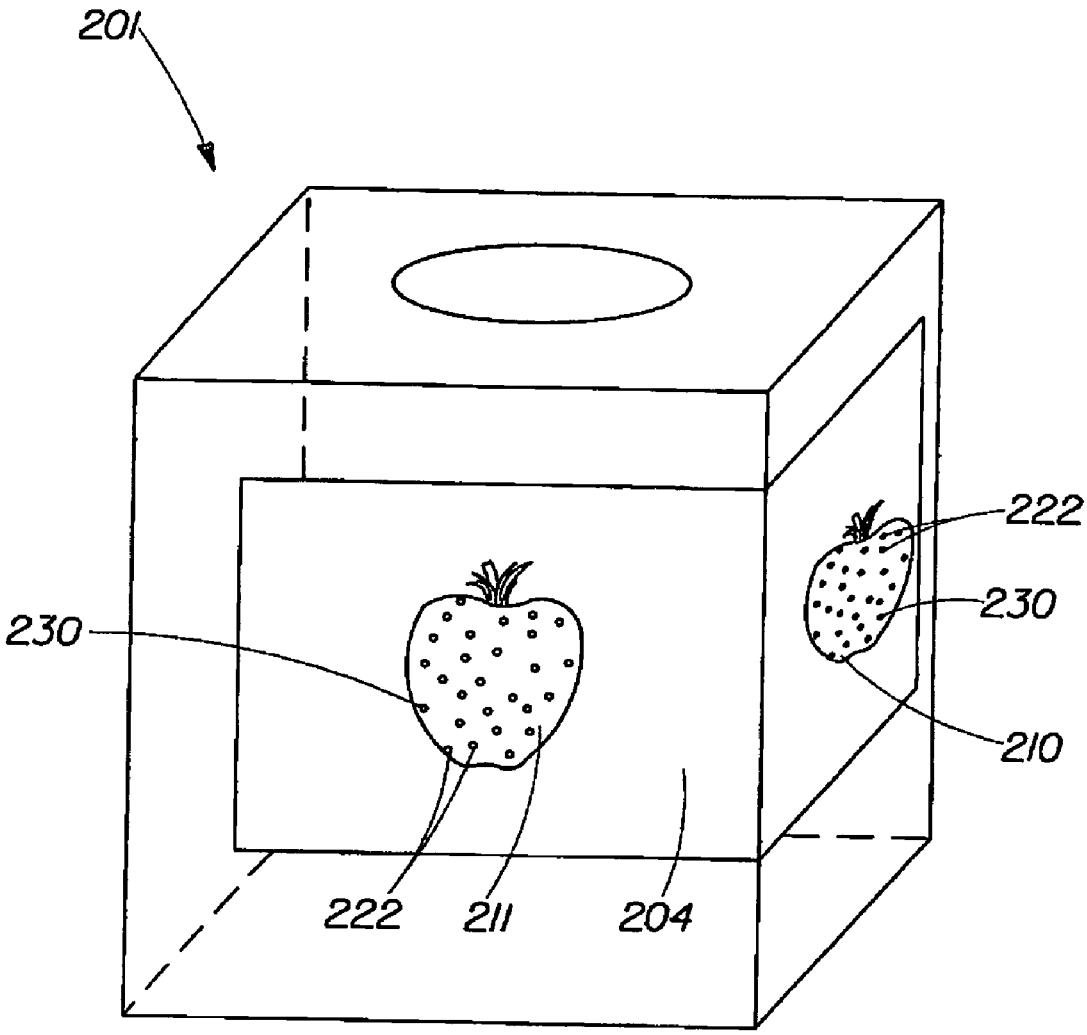
FIG. 9 is an isometric view of yet another embodiment of the present invention.

FIG. 9 shows another example of a container 201 according to the present invention, wherein the container 201 includes first indicia 210 and second indicia 210, wherein the first indicia 210 and the second indicia 211 are generally the same or at least related to each other. Thus, in this example the strawberry depicted by the first indicia 210 and the strawberry depicted by second indicia 211 are generally the same. The container 201 also includes apertures 222 that depict strawberry seeds and are related to the indicia 210 and 211.

The container 201 may also include a volatile material 230 comprising a fragrance that relates to the first and second indicia 210 and 211. Further, the container 201 may include a releasably attached cover layer 204 (or cover layers as described above) allowing the user to expose the volatile material 230 corresponding with each indicia 210 or 211 individually or simultaneously. Thus, the user is given the option of controlling how strong the fragrance associated with the volatile material 230 is in the environment at any particular time. The cover layer 204 can be resealable to permit the user to increase or decrease the amount of volatile being released.

The examples describe containers including two similar or a combination of two different indicia and their related apertures and fragrances, but other containers wherein there are more than two combinations of indicia, apertures and fragrances that may or may not be all or partially related to each other are also contemplated by the present invention.

While certain embodiments of the present invention may contemplate a facial tissue container for use indoors, it might also be desirable to provide a container suitable for outdoor use or use in an environment other than a room or enclosed space. An example of a container for outdoor use might include materials that are more resistant to the conditions associated with outdoor use, such as for example, rain, sunlight, and increased handling. The container might be used for storing and dispensing tissue or wipes, and in particular wipes impregnated with a chemical, such as, for example, an insect repellant, sunscreen, cleanser or moisturizer. In such an embodiment the container could include indicia that depict, for example, a scene commonly associated with outdoor activities, such as, for example, a family on a camping trip or a scene including a forest. The container might further include apertures that relate to the indicia of the outdoor scene, and depict, for example, a mosquito or other insect.

While some of the examples mentioned above may contemplate a volatile material that includes a generally pleasant smelling fragrance, it is to be understood that the volatile material may comprise a fragrance not detectable by the user, or may not comprise a fragrance at all, such as, for example, citronella or N,N-diethyl-meta-toluamide (DEET). Thus, in one exemplary embodiment, the container could include a volatile material including, for example, citronella, an aperture in the shape of or otherwise depicting a mosquito, and indicia depicting an outdoor scene. Thus, the volatile material, the aperture(s) and the indicia are all related to each other.

All documents cited in the Detailed Description of the Invention are, in relevant part, incorporated by reference herein; the citation of any document is not to be construed as an admission that it is prior art with respect to the present invention. To the extent that any meaning or definition of the term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A disposable container for storing and dispensing products, the disposable container having one or more sides defining an external surface and an internal surface such that the internal surface defines a partially or wholly enclosed internal space for storing the products, the container having an opening disposed upon a first of the container sides, the opening providing access to and removal of the products from the disposable container, the disposable container further comprising:

a. one or more apertures disposed upon a second of the container sides and extending from the internal surface to the external surface;

b. an impermeable carrier material having a first side and a second side having a volatile material disposed thereon, wherein the second side of the carrier material is joined to the internal surface of the second of the container sides and adjacent the one or more apertures such that the volatile material, when volatilized, can pass through the one or more apertures to an external environment.

2. The disposable container of claim 1 wherein the carrier material is vapor impermeable.

3. The disposable container of claim 1 comprising one or more cover layers attached to the container such that the one or more cover layers substantially cover at least some of the one or more apertures and thereby limit the amount of volatile material passing through the one or more apertures to the external environment.

4. The disposable container of claim 3 including two or more separate cover layers that are removable independently from each other.

5. The disposable container of claim 1 wherein the volatile material comprises a fragrance composition, aromatherapy composition or an insect repellant.

6. The disposable container of claim 1 comprising one or more indicia visually detectable by the human eye when in normal use.

7. The disposable container of claim 6 wherein at least one of the one or more indicia is related to the volatile material.

8. The disposable container of claim 6 wherein the one or more apertures together or separately provide a shape that relates to at least one of the one or more indicia.

9. The disposable container of claim 1 wherein the one or more apertures together or separately provide a shape that relates to the volatile material.

10. The disposable container of claim 1 wherein the products stored in the container include facial tissues or a wipes.

11. The disposable container of claim 1 including at least a first indicia and a second indicia that is discrete from the first indicia.

12. The disposable container of claim 11 including a first volatile material and a second volatile material, wherein the first volatile material is associated with the first indicia and the second volatile material is associated with the second indicia.

13. A blank for forming a disposable container for storing and dispensing products, the blank having a first side, a second side, a third side, a fourth side and a fifth side, the blank being manipulatable into a disposable container having a generally parallelepiped shape wherein the parallelepiped has an internal surface and an external surface such that the internal surface defines a partially or wholly enclosed internal space for the storage of products, wherein the first side has an opening disposed thereon, the opening facilitating the removal of any products contained within the disposable container, and wherein at least one side of the parallelepiped comprises the fifth side, the fifth side having a first surface and a second surface, having a volatile material disposed therein or thereon, the blank further comprising one or more apertures disposed within the second side of the blank and extending completely therethrough, wherein the one or more apertures are disposed adjacent the second surface of the fifth side of the disposable container such that the volatile material, when volatilized, can only pass through the one or more apertures to an external environment.

14. The blank of claim 13 wherein the volatile material comprises a fragrance composition.

15. The blank of claim 13 wherein the blank includes one or more indicia that are visually detectable by a user once the blank is constructed into a container.

16. The blank of claim 15 wherein at least one of the one or more indicia are related to the volatile material.

17. The blank of claim 15 wherein the one or more apertures together or separately comprise a shape that relates to at least one of the one or more indicia.

18. The blank of claim 13 wherein the one or more apertures together or separately comprise a shape that relates to the volatile material.

19. A disposable container for storing and dispensing products, the disposable container having one or more sides defining a generally parallelepipedal external surface and an internal surface such that the internal surface defines a partially or wholly enclosed internal space for storing the products, the disposable container further comprising:

a. an opening disposed on one of the container sides, the opening providing access to and removal of the products from the disposable container;

b. one or more apertures disposed on a second of the container sides, the one or more apertures extending from the internal surface to the external surface;

c. an impermeable carrier material having a first side and a second side a volatile material disposed thereon, wherein the second side of the carrier material is joined to a second side of the container and adjacent the one or more apertures such that the volatile material, when volatilized, can pass through at least one of the one or more apertures to an external environment;

d. a substantially vapor impermeable cover layer releasably attached to the external surface of the second side of the container such that the cover layer substantially covers the one or more apertures and thereby limits the amount of volatile material passing through the one or more apertures to the external environment; and e. one or more indicia disposed on the container such that the one or more indicia can be visually detected by the human eye when in normal use, wherein the one or more indicia are related to one or more of the apertures or the volatile material.

20. The disposable container of claim 19 wherein the one or more indicia, the one or more apertures and the volatile material are all related to each other.

* * * * *